US006142154A

United States Patent [19]

Dall'Osso et al.

[11] Patent Number: 6,142,154

[45] Date of Patent: Nov. 7, 2000

[54] METHOD OF FEEDING WRAPPER MATERIAL IN MANUFACTURING MACHINES

[75] Inventors: Davide Dall'Osso; Massimo Sartoni, both of Bologna; Fiorenzo Draghetti, Medicina, all of Italy

[73] Assignee: G.D S.p.A., Bologna, Italy

[21] Appl. No.: 08/997,094

[22] Filed: Dec. 23, 1997

[30] Foreign Application Priority Data

Dec. 24, 1996 [IT] Italy ..... BO96A0684

[51] Int. Cl.[7] ..... A24C 5/14; A24C 5/31

[52] U.S. Cl. ..... 131/60; 131/67

[58] Field of Search ..... 131/280, 60, 67

[56] References Cited

U.S. PATENT DOCUMENTS 3,614,957 10/1971 Verbakel .
4,666,550 5/1987 Spiers et al. .
5,156,169 10/1992 Holmes et al. .
5,220,930 6/1993 Gentry .

FOREIGN PATENT DOCUMENTS 180 901 5/1986 European Pat. Off. .
402 059 12/1990 European Pat. Off. .
35 33 275 3/1987 Germany .
2 154 494 9/1985 United Kingdom .

*Primary Examiner*—Christopher A. Fiorilla
*Attorney, Agent, or Firm*—Pillsbury Madison & Sutro LLP

[57] ABSTRACT

In a method of feeding wrapper material, typically as utilized by machines for the manufacture of tobacco products, a first and a second strip presenting two longitudinal side edges and of dissimilar transverse dimensions are advanced along respective predetermined first feed lines, positioned one relative to another in a direction transverse to the respective first feed lines in such a way as to bring about their alignment along one longitudinal edge and finally joined face to face before advancing together along a predetermined common feed line toward a machine unit.

13 Claims, 5 Drawing Sheets

METHOD OF FEEDING WRAPPER MATERIAL IN MANUFACTURING MACHINES

BACKGROUND OF THE INVENTION

The present invention relates to a method of feeding wrapper material in manufacturing machines.

The present invention finds application in machines for the manufacture of tobacco products, typically cigarettes, and relates in particular to a method by which a wrapper material consisting of two continuous strips joined face to face and positioned one relative to the other is fed to a machine unit; while reference is made specifically herein to the use of such a method in cigarette manufacturing machines, no limitation in general scope is implied.

A cigarette manufacturing machine of conventional type comprises a forming station appearing essentially as a beam, of which the function is to assemble and shape a continuous cigarette rod, or a plurality of such rods generated parallel one with another. The station affords an entry point where at least one ribbon of tobacco filler is dispensed onto a looped conveyor belt slidably supporting a strip of cigarette paper. The paper for each cigarette rod is advanced and at the same time forced by the conveyor belt to envelop the tobacco filler, thus fashioning a single wrapper around the tobacco and creating a continuous cigarette cylinder or rod, which will then be divided into single cigarettes by a cutting device.

The prior art, as reflected in EP 402 059, embraces cigarettes furnished with two skins of paper wrapped one over the other around the tobacco filler, which are designed to minimize the lateral flow of smoke through the cigarette.

The object of the present invention is to provide a method that will allow of fashioning cigarettes with a double skin of wrapper material automatically, while ensuring speed and precision.

SUMMARY OF THE INVENTION

The stated object and others are realized in a method of feeding wrapper material in manufacturing machines according to the present invention, which comprises: advancing at least a first and a second strip of wrapper material along respective predetermined first feed lines, each strip presenting two longitudinal side edges, and one strip exhibiting a transverse dimension greater than the transverse dimension of the other; positioning the first and the second strip mutually in a predetermined manner along a direction transverse to the respective predetermined first feed lines; joining the first and second strips together face to face and advancing both along a predetermined common feed line toward a machine unit.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
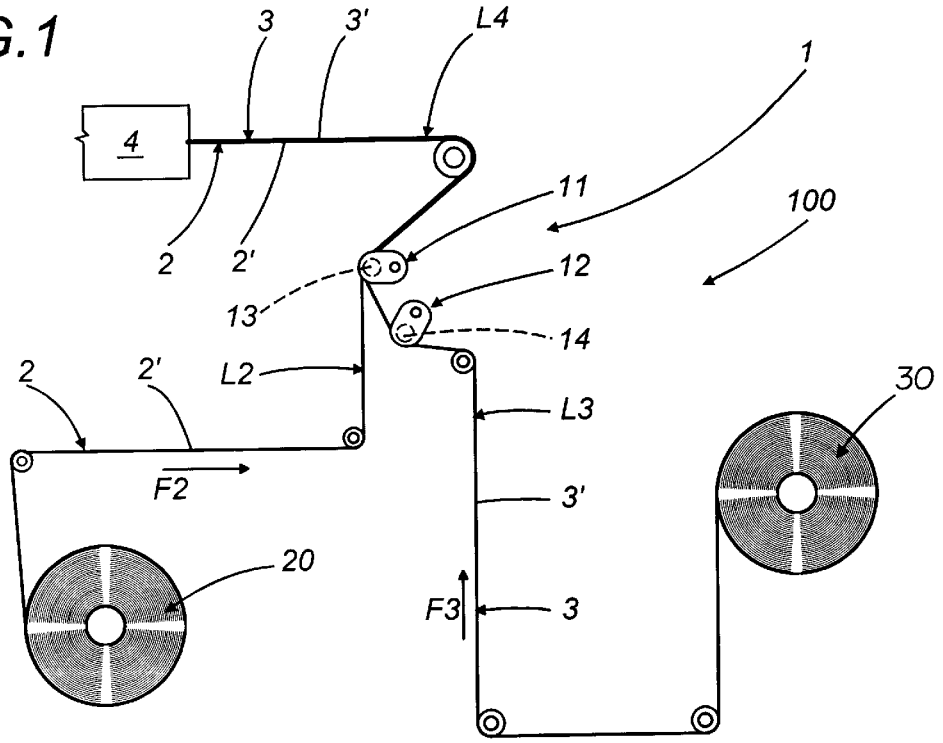
FIG. 1 is a diagrammatic side view showing one portion of a manufacturing machine equipped with a positioning device designed to implement the method of the present invention, illustrated in a first embodiment.
Figure 2:
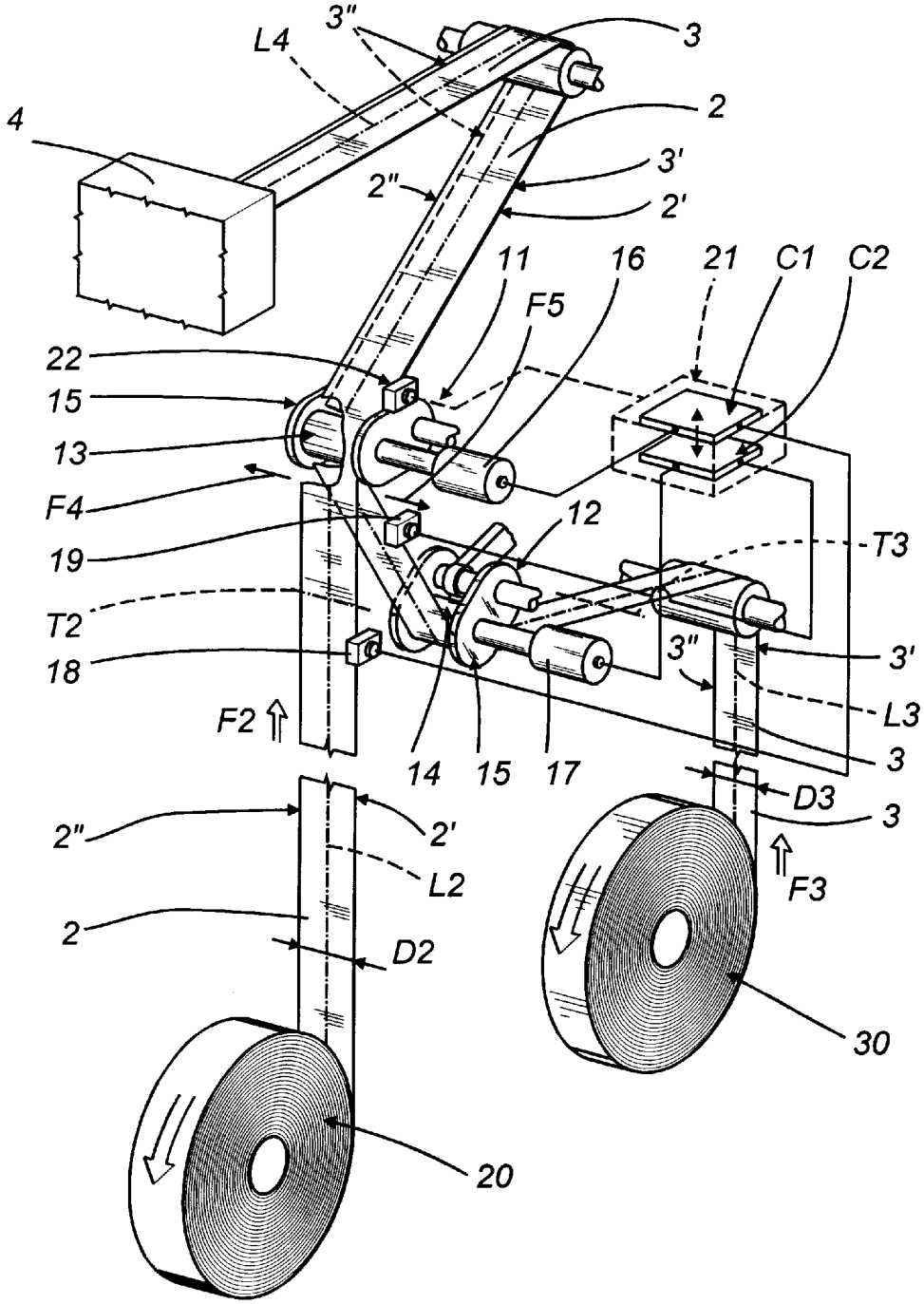
FIG. 2 is an enlarged perspective view of FIG. 1.

With reference to FIGS. 1 and 2 of the accompanying drawings, 100 denotes a portion of a manufacturing machine furnished among other elements with a device, denoted 1 in its entirety, of which the function is to position a first strip 2 and a second strip 3 of wrapper material one in relation to another.

The portion 100 in question establishes two first feed lines of which one, denoted L2, is followed by the first strip 2 and the other L3, is followed by the second strip 3. In operation, the two strips 2 and 3 are decoiled from bulk rolls 20 and 30 and directed along their predetermined feed lines L2 and L3 toward the positioning device 1. The transverse dimension D2 of the first strip 2, as measured between the two respective longitudinal edges 2' and 2", is greater than the corresponding transverse dimension D3 of the second strip 3, measured likewise between the respective longitudinal edges 3' and 3".

As discernible from FIG. 1 and FIG. 2, the positioning device 1 comprises diverter means 11 and 12 consisting respectively in a first guide roller 13 and a second guide roller 14, each fitted bilaterally with flanges 15 acting as restraints respectively for one of the two longitudinal edges 2' or 2" of the first strip 2 and for the longitudinal edges 3' and 3" of the second strip 3, as the running strips 2 and 3 pass over the respective rollers 13 and 14.

The two rollers 13 and 14 are coupled to respective first and second double acting linear actuators 16 and 17 of which the function is to shift each roller 13 and 14 selectively along a corresponding direction T2 and T3 transverse to the relative feed line L2 and L3, effecting a forward stroke F4 or a return stroke F5 as indicated in FIG. 2.

Still referring to FIG. 2, the positioning device 1 comprises a first sensor 18 and a second sensor 19 offered respectively to the first strip 2 and to the second strip 3 and designed to monitor the position occupied by each strip 2 and 3 along the respective transverse directions T2 and T3. The outputs of the first and second sensors 18 and 19 are connected to the input of a central control unit 21, which in turn is connected on the output side to the inputs of the first and second actuators 16 and 17. In particular, the central control unit 21 comprises a first and a second monitoring and control module denoted C1 and C2 respectively, and it is to these that the outputs of the first and second sensors 18 and 19 are connected. As discernible from FIG. 2, the second monitoring and control module C2 is interlocked operationally to the first monitoring and control module C1.

In the interests of providing a full specification and ensuring that the embodiment and operation of the positioning device 1 are readily comprehended, a brief account will now be given of what occurs beyond the guide rollers 13 and 14.

The two strips 2 and 3 advancing along the two respective feed lines L2 and L3 are joined face to face at the guide rollers 13 and 14 and directed thereafter along a predetermined common feed line, denoted L4 in FIG. 1, toward a machine unit 4 that forms part of the selfsame portion 100 of the machine.

In operation, referring to FIGS. 1 and 2, each of the strips 2 and 3 is decoiled from a respective roll 20 and 30 and caused to advance along the respective feed line L2 and L3 in a predetermined direction denoted F2 and F3 respectively. The second strip 3 is directed initially over the second guide roller 14, wrapping around a portion of the surface, then onto the first guide roller 13.

At the same time, the first strip 2 is routed directly onto the first guide roller 13, wrapping around a part of the surface, and in the process laid over the second strip 3 in flush contact, face to face.

The two strips 2 and 3 are positioned one relative to the other in the following manner.

The first sensor 18 detects the position of the one strip 2 in the corresponding transverse direction T2, relative to the feed line L2, and relays a first signal to the first monitoring and control module C1. Similarly, the second sensor 19 detects the position of the other strip 3 along the corresponding transverse direction T3 relative to the feed line L3 and relays a second signal to the second monitoring and control module C2 which, to reiterate, is interlocked to the first monitoring and control module C1.

The central control unit 21 compares the two signals and, according to the type of positional arrangement programmed for the two strips 2 and 3, generates an output signal from the second monitoring and control module C2 to activate the respective actuator 17, with the result that the corresponding guide roller 14 is displaced along the transverse direction T3.

The strip 3 is thus shifted together with the guide roller 14, moving transversely to the feed line L3, and centered on a given pass line calculated to bring about the required positional relationship with the first strip 2.

The two strips 2 and 3 are joined face to face at the first diverter means 11 and caused to advance as one along a common feed line L4, toward the machine unit 4.

Clearly, the step of positioning the strips 2 and 3 relative to one another might be effected differently. For example, the first actuator 16 could be operated rather than the second actuator 17, in such a way as to shift the first strip 2 in the relative transverse direction T2 and thus adapt its position to that of the second strip 3. Alternatively, both of the guide rollers 13 and 14 could be adjusted so as to move the strips 2 and 3 more rapidly into the required mutual positions.

The positioning device 1 also comprises a sensor 22 offered to the first and second strips 2 and 3 at a point beyond the first and second guide rollers 13 and 14 in the feed direction, along the common feed line L4, and connected to the central control unit 21. The function of this sensor 22 is to verify the correct positioning of the first strip 2 and the second strip 3 one in relation to another.

In the example of FIG. 2, the two strips 2 and 3 are aligned along one of the two longitudinal edges 2' or 2" of the first strip 2, or similarly along one of the two edges 3' or 3" of the second strip 3.

Figure 3:
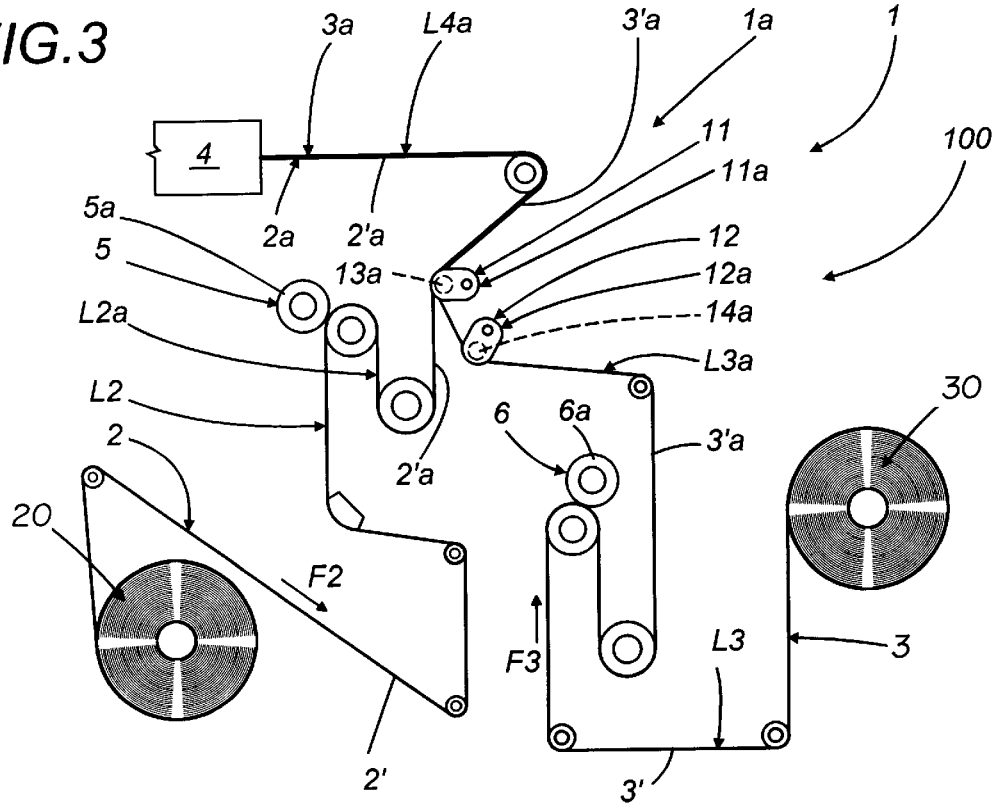
FIG. 3 is a diagrammatic side view showing a portion of a manufacturing machine as in FIG. 1, equipped with a positioning device designed to implement the method of the present invention, illustrated in a second embodiment.
Figure 4:
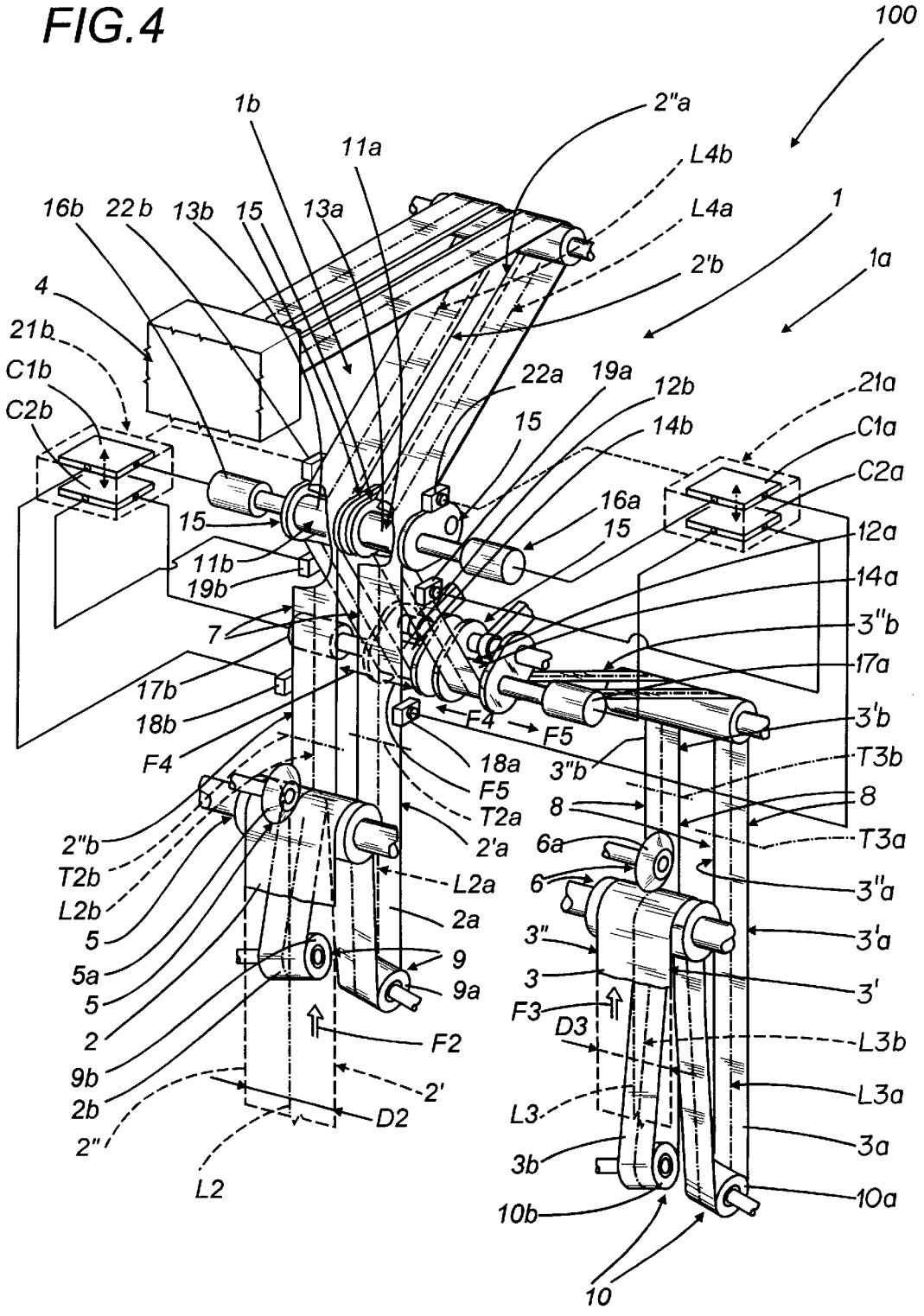
FIG. 4 is an enlarged perspective view of FIG. 3.

In the embodiment of FIGS. 3 and 4, the first strip 2 and the second strip 3 are decoiled from respective rolls 20 and 30 and advanced along corresponding feed lines L2 and L3 in exactly the same way as already indicated with reference to FIGS. 1 and 2, following the same respective directions F2 and F3.

For each strip 2 and 3 advancing along a respective feed line L2 and L3 in this solution, the positioning device 1 comprises cutting means 5 and 6 that consist respectively in a first rotating disc cutter 5*a* by which the first strip 2 is divided longitudinally to generate a first pair 7 of first strips 2*a* and 2*b*, and a second rotating disc cutter 6*a* by which the second strip 3 is divided longitudinally to generate a second pair 8 of second strips 3*a* and 3*b*. Located following each disc cutter 5*a* and 6*a* along the respective feed direction are divaricating means 9 and 10 respectively comprising two divergently skew rollers denoted 9*a* and 9*b* and two divergently skew rollers denoted 10*a* and 10*b*.

The two first strips 2*a* and 2*b* are spread apart transversely by the rollers 9*a* and 9*b* and made thus to advance along respective predetermined second feed lines denoted L2*a* and L2*b* in FIG. 4. Similarly, the two second strips 3*a* and 3*b* are spread apart transversely by the relative rollers 10*a* and 10*b* and made to advance along respective predetermined second feed lines denoted L3*a* and L3*b* in FIG. 4.

It will be observed that each first strip 2*a* and 2*b* exhibits a transverse dimension greater than the same dimension of the corresponding second strip 3*a* and 3*b*. The two longitudinal edges of one first strip 2*a* are denoted 2'*a* and 2"*a* and the two longitudinal edges of the other first strip 2*b* denoted 2'*b* and 2"*b*, whilst the two longitudinal edges of one second strip 3*a* are denoted 3'*a* and 3"*a* and the two longitudinal edges of the other second strip 3*b* denoted 3'*b* and 3"*b*.

Thus in the example of FIG. 4 use is made of a double positioning device 1 that consists effectively of a first positioning device 1*a* and a second positioning device 1*b*. The function of the one device 1*a* is to position one set of first and second strips 2*a* and 3*a* one relative to another, and the function of the other device 1*b* to position the remaining set of first and second strips 2*b* and 3*b* one in relation to the other.

In entirely the same way as described above for the solution illustrated in FIGS. 1 and 2, the positioning devices 1*a* and 1*b* in the example of FIG. 4 comprise first diverter means 11*a* and 12*a* respectively engaging the two first strips 2*a* and 3*a*, and second diverter means 11*b* and 12*b* respectively engaging the two second strips 3*a* and 3*b*.

Diverter means 11*a*, 11*b* and 12*a*, 12*b* again consist in respective first guide rollers 13*a*, 13*b* and second guide rollers 14*a*, 14*b* each furnished bilaterally with restraining flanges 15 and associated with respective double acting first linear actuators 16*a*, 16*b* and second linear actuators 17*a*, 17*b* capable of effecting a forward stroke F4 and a return stroke F5 by which the relative guide rollers 13*a*, 13*b* and 14*a*, 14*b* are caused to shift in the transverse direction.

Each positioning device 1*a* and 1*b* comprises a first and a second sensor, denoted 18*a* and 18*b* respectively in the case of those associated with the first pair 7 of first strips 2*a* and 2*b*, and denoted 19*a* and 19*b* respectively in the case of those associated with the second pair 8 of second strips 3*a* and 3*b*. The function of each sensor 18*a*, 18*b*, 19*a* and 19*b* is to detect the position occupied by the respective strip 2*a*, 2*b*, 3*a* and 3*b* in the direction T2*a*, T2*b*, T3*a* and T3*b* transverse to the corresponding feed line L2*a*, L2*b*, L3*a* and L3*b*.

The outputs of the sensors 18*a*, 18*b* and 19*a*, 19*b* are connected to the inputs of respective central control units 21*a* and 21*b*, each comprising first and second monitoring and control modules denoted C1*a* and C2*a* and C1*b* and C2*b* respectively, which are connected on the output side to the corresponding inputs of the first actuators 16*a*, 16*b* and the second actuators 17*a*, 17*b*.

As discernible in FIG. 4, each second monitoring and control module C2*a*, C2*b* is interlocked operationally to the respective first monitoring and control module C1*a*, C1*b*.

Likewise in this solution the positioning devices 1*a* and 1*b* comprise respective sensors 22*a* and 22*b* monitoring the first and second strips 2*a*, 2*b* and 3*a*, 3*b* at points beyond the guide rollers 13*a*, 13*b* and 14*a*, 14*b*, along the respective common feed lines L4*a* and L4*b*, which serve to verify the correct relative positioning of the first and second strips 2*a*, 2*b* and 3*a*, 3*b*.

In operation, observing FIGS. 3 and 4 and recalling the foregoing description of the solution illustrated in FIGS. 1 and 2, the first and second strips 2 and 3 are decoiled from two rolls 20 and 30 (not indicated in FIG. 4) and drawn along respective feed lines L2 and L3 in predetermined directions respectively denoted F2 and F3. Advancing along the relative feed line L2, the first strip 2 initially encounters the rotating disc cutter 5*a* and is divided into the two first strips 2*a* and 2*b* which proceed along their predetermined feed lines L2*a* and L2*b*, passing around the respective skew rollers 9*a* and 9*b* and spreading apart transversely. Similarly, advancing along the relative feed line L3, the second strip 3 encounters the disc cutter 6*a* and is divided into the two second strips 3*a* and 3*b* which proceed along their predetermined feed lines L3*a* and L3*b*, passing around the respective skew rollers 10*a* and 10*b* and spreading apart transversely.

As to the subsequent steps whereby the pairs 7 and 8 of first strips 2*a*, 2*b* and second strips 3*a*, 3*b* are positioned relative to one another by the respective devices 1*a* and 1*b*, the principle remains the same as already described in connection with the embodiment of FIGS. 1 and 2, and accordingly, the positioning steps relating to the example of FIGS. 3 and 4 will not be described further.

It will be noted nonetheless that in this solution, as in the first described, the mutual positioning of the pairs 7 and 8 of strips will involve aligning the first strips 2*a*, 2*b* and the second strips 3*a*, 3*b* along one of the two longitudinal edges 2', 2*a* "or 2'*b*, 2"*b* of each first strip 2*a* or 2*b* or along one of the two longitudinal edges 3', 3*a* "or 3'*b*, 3"*b* of each second strip 3*a* or 3*b*.

Figure 5:
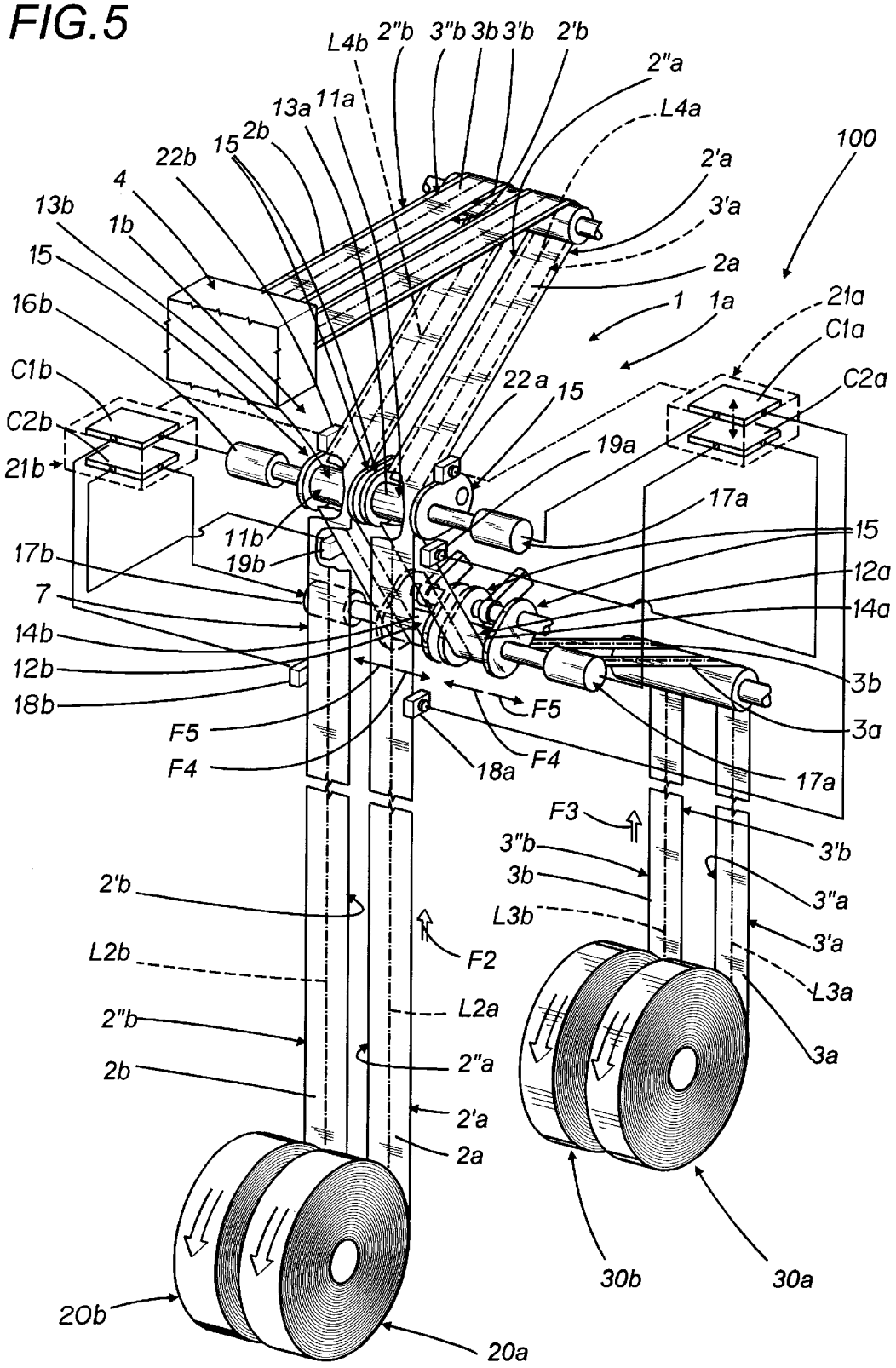
FIG. 5 is the perspective view of a positioning device according to the present invention, illustrated in a further embodiment.

In the example of FIG. 5, the single rolls 20 and 30 are replaced by pairs of rolls denoted 20*a*, 20*b* and 30*a*, 30*b* respectively. The first strips 2*a* and 2*b* are decoiled respectively from the one pair of rolls 20*a* and 20*b*, and the second strips 3*a* and 3*b* respectively from the other pair of rolls 30*a* and 30*b*.

The step of dividing a first and second strip 2 and 3 longitudinally by means of respective rotating disc cutters 5*a* and 6*a* is dispensed with in this example, while the positioning step, which remains entirely the same as described already with reference to the example of FIGS. 1 and 2, consists in positioning the first strips 2*a*, 2*b* and the second strips 3*a*, 3*b* one with respect to the other, through the agency of the relative device 1*a* and 1*b*, in a manner that does not involve aligning the strips along one of the two longitudinal edges.

Figure 6:
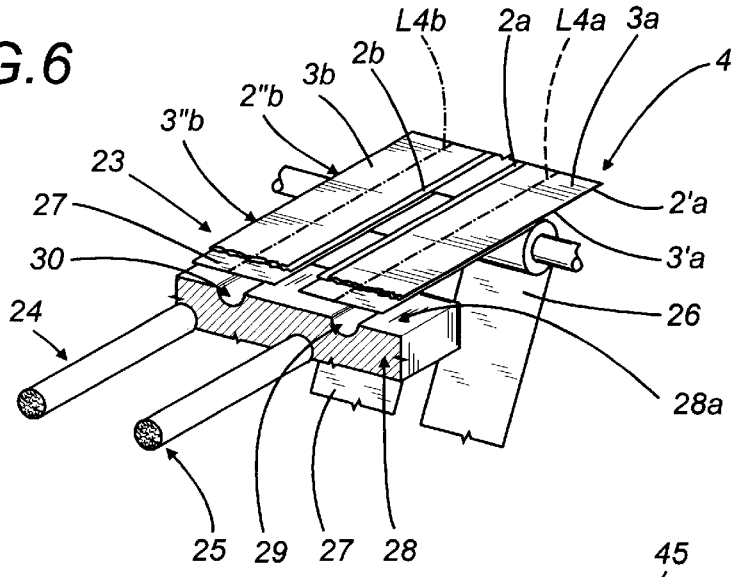
FIG. 6 is a detail of FIG. 4 illustrated in perspective and in a first possible embodiment.

FIG. 6 indicates the machine unit 4 as comprising a station 23 for the formation of one or more continuous cigarette rods, denoted 24 and 25 respectively. The two first strips 2*a*, 2*b* and the corresponding second strips 3*a*, 3*b* enter the forming station 23 joined face to face, advancing along the common feed lines L4*a* and L4*b*, having passed around a roller 50 and onto the top branches of two looped conveyor belts 26 and 27 which run slidably on two parallel guides or channels 29 and 30 of a substantially horizontal platform 28*a* afforded by a beam 28. The two sets of strips 2*a*, 3*a* and 2*b*, 3*b* pass onto the platform 28*a* with the strip denoted 3*a* on top of that denoted 2*a* and the strip denoted 3*b* on top of that denoted 2*b*. Shredded tobacco fillers (not illustrated) are dispensed in conventional manner onto the two uppermost strips 3*a* and 3*b* during the course of their passage across the platform 28*a*.

The two sets of strips 2*a*, 3*a* and 2*b*, 3*b* are caused by the two channels 29 and 30 to wrap gradually around the tobacco fillers, forming two continuous cigarette rods 25 and 24 that will be divided subsequently into single cigarettes 40. As discernible from FIG. 7, each cigarette 40 generated in this manner will exhibit two skins 42 and 43 obtained by wrapping the two matched strips 2*a*, 3*a* and 2*b*, 3*b* about the respective tobacco fillers.

Figure 8:
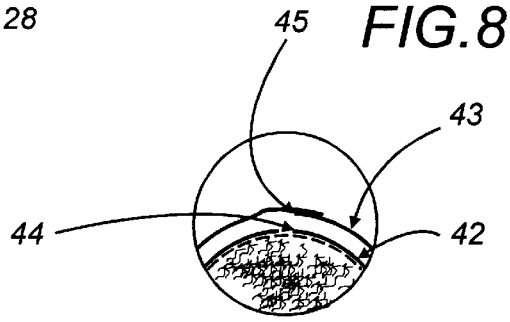
FIG. 8 is a detail of FIG. 7.
Figure 7:
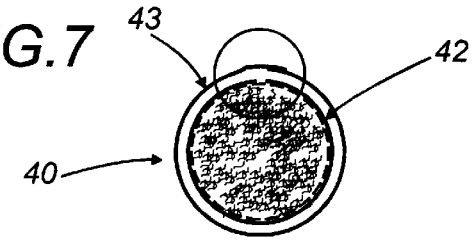
FIG. 7 is the front elevation of a cigarette with a double skin of wrapper material obtained by the method according to the present invention.

Still referring to FIG. 7, and observing the detail of FIG. 8, each cigarette appears with the inner and outer skins 42 and 43 aligned along one longitudinal edge 44 and 45.

Figure 9:
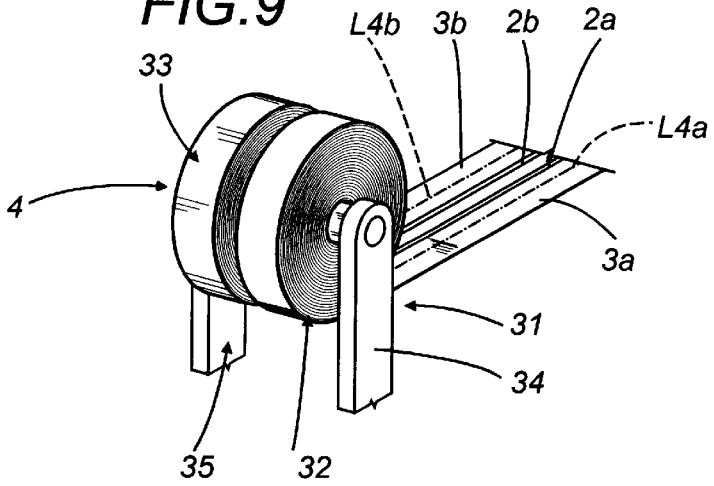
FIG. 9 is a detail of FIG. 4 illustrated in perspective and in a second possible embodiment.

In the example of FIG. 9, the machine unit 4 consists in a coiling station 31 where the sets of first and second strips 2*a*, 3*a* and 2*b*, 3*b*, matched and mutually positioned, are wound onto respective rolls 32 and 33 carried by respective support arms 34 and 35.

The two rolls 32 and 33 obtained in this way are thus ready to feed respective preassembled first and second strips 2*a*, 3*a* and 2*b*, 3*b* to any given machine unit 4 of any given manufacturing machine.

What is claimed:

1. A method of feeding wrapper material in manufacturing machines, comprising:

advancing at least a first and a second strip of wrapper material alone respective first and second feed lines, each strip presenting two longitudinal side edges and one strip exhibiting a transverse dimension greater than the transverse dimension of the other strip;

positioning the first and the second strip mutually along a direction transverse to the respective first and second feed lines;

joining the first and second strips together face to face and advancing both along a common feed line toward a machine unit;

decoiling each strip initially from a respective roll;

dividing each of the first and second strips longitudinally by respective cutters to generate a first pair of first strips and a second pair of second strips;

causing each of the two first strips and each of the two second strips to spread apart transversely one from another and to advance thereafter along respective second feed lines;

positioning each first strip of the first pair and each second strip of the second pair relative to one another in overlapping relation, in sets of two, along a direction transverse to the respective pre-determined second feed line;

joining each first strip of the first pair face to face with a corresponding second strip of the second pair and advancing both together along a respective predetermined common feed line.

2. A method as in claim 1, wherein the positioning further comprises aligning each strip with the corresponding strip along one of the respective two longitudinal side edges of the strips.

3. A method as in claim 1, wherein the strips are positioned relative one to another by a positioning device comprising respective diverters associated with the strips, which are constructed and arranged to displace at least one of the first and second strips along a direction transverse to the respective feed line.

4. A method as in claim 3, wherein each diverter comprises a first and a second guide roller fitted bilaterally with flanges serving to restrain at least one of the two longitudinal side edges of each first and second strip, which are coupled to a respective first and second actuator and capable thus of movement in the transverse direction, the movement generated by a forward stroke and a return stroke of the relative actuator.

5. A method as in claim 4, wherein at least one of the first and second guide rollers is displaced along the transverse direction during positioning of the first and the second strip in such a manner that on completion of the positioning operation, the first and second strips occupy overlapping positions one relative to another.

6. A method as in claim 4, wherein at least one of the first and second guide rollers is displaced along the transverse direction during positioning of the first and the second strip in such a way that on completion of the positioning operation, the first and second strips occupy relative positions in which each first or second strip is aligned with the corresponding second or first strip along at least one of the respective two longitudinal side edges presented by the first or second strip.

7. A method as in claim 4, wherein the positioning device comprises a first and a second position sensor constructed and arranged to monitor the respective first and second strip in such a way as to detect the position of the strip in the transverse direction, and connected to a central control unit which on receiving signals from the first sensor and second sensor is designed to control the operation of at least one of the actuators to displace the associated guide roller along the transverse direction.

8. A method as in claim 7, wherein the central control unit comprises a first and a second monitoring and control module connected respectively on an input side to the first and second sensors and on an output side to the first and second actuators, and in such a way that the operation of one of the first and second monitoring and control modules is interlocked to the other monitoring and control module.

9. A method according to claim 8, wherein the positioning device comprises a sensor constructed and arranged to monitor the first and second strips at a point beyond the first and second guide rollers in the feed direction, along the common feed line, and constructed and arranged to verify the correct positioning of the first and second strips.

10. A method as in claim 7, wherein the positioning device comprises a sensor constructed and arranged to monitor the first and second strips at a point beyond the first and second guide rollers in the feed direction, along the common feed line, and constructed and arranged to verify the correct positioning of the first and second strips.

11. A method as in claim 1, wherein the machine unit further comprises a forming station by which one or more continuous cigarette rods are generated.

12. A method as in claim 1, wherein the machine unit further comprises a coiling station at which the first and second strips advancing along each common feed line, joined face to face and positioned one relative to the other, are wound into respective rolls.

13. A method of feeding wrapper material in manufacturing machines, comprising:

advancing at least a first and a second strip of wrapper material along respective first and second feed lines, each strip presenting two longitudinal side edges and one strip exhibiting a transverse dimension greater than the transverse dimension of the other strip;

positioning the first and the second strip mutually along a direction transverse to the respective first and second feed lines;

joining the first and second strips together face to face and advancing both alone a common feed line toward a machine unit;

decoiling each of the two first strips of the first pair and each of the two second strips of the second pair from a respective roll advancing each of the two first strips of the first pair and each of the two second strips of the second pair along a respective predetermined second feed line positioning each first strip of the first pair and each second strip of the second pair relative to one another in overlapping relation in sets of two along a direction transverse to the respective predetermined second feed line;

joining each first strip of the first pair face to face with the corresponding second strip of the second pair and advancing both together along a common feed line toward a machine unit.

* * * * *